US008979584B2

(12) United States Patent
Tsuchiya

(10) Patent No.: US 8,979,584 B2
(45) Date of Patent: Mar. 17, 2015

(54) BOARD-MOUNTED CONNECTOR

(75) Inventor: Kazuhiko Tsuchiya, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/818,324

(22) PCT Filed: Aug. 31, 2011

(86) PCT No.: PCT/JP2011/069786

§ 371 (c)(1),
(2), (4) Date: Feb. 22, 2013

(87) PCT Pub. No.: WO2012/029859

PCT Pub. Date: Mar. 8, 2012

(65) Prior Publication Data

US 2013/0149902 A1 Jun. 13, 2013

(30) Foreign Application Priority Data

Aug. 31, 2010 (JP) ..... 2010-194471

(51) Int. Cl.
*H01R 13/648* (2006.01)
*H01R 13/658* (2011.01)
(Continued)

(52) U.S. Cl.
CPC ..... *H01R 13/648* (2013.01); *H01R 13/658* (2013.01); *H01R 13/6593* (2013.01); *H01R 13/6581* (2013.01); *H01R 13/502* (2013.01); *H01R 13/6594* (2013.01); *H01R 12/724* (2013.01)
USPC ..... 439/607.27; 439/607.35

(58) Field of Classification Search
USPC ..... 439/607.34, 607.35, 607.55, 607.27
See application file for complete search history.

(56) References Cited

U.S. PATENT DOCUMENTS 4,894,026 A 1/1990 Dixon et al.
4,913,664 A 4/1990 Dixon et al.
(Continued)

FOREIGN PATENT DOCUMENTS

CN 201252259 Y 6/2009
EP 0370833 A2 5/1990
(Continued)

OTHER PUBLICATIONS

International Search Report (PCT/ISA/210), dated Nov. 15, 2011, issued by the International Searching Authority in counterpart International Patent Application No. PCT/JP2011/069786.
(Continued)

*Primary Examiner* — Neil Abrams
*Assistant Examiner* — Travis Chambers
(74) *Attorney, Agent, or Firm* — Sughrue Mion, PLLC

(57) ABSTRACT

An object is to provide a board-mounted connector which has an assembly fitting opening provided on the attachment surface side of an external shield shell onto a circuit board such that a housing assembly can be fit from the assembly fitting opening into the external shield shell, and is capable of improving the ease of assembling the housing assembly. In a board-mounted connector 1A, a housing assembly 21A to be fit from an assembly fitting opening 34 provided at an external shield shell 11A into the external shield shell 11A is made by integrally forming an internal housing 23 that accommodates a plurality of connection terminal members 22 and an external housing 26 that covers the outer circumference of the internal housing 23 and accommodates and holds the internal shield shell 25.

1 Claim, 11 Drawing Sheets

(51) Int. Cl.

| | |
|---|---|
| ***H01R 13/6593*** | (2011.01) |
| ***H01R 13/6581*** | (2011.01) |
| ***H01R 13/6594*** | (2011.01) |
| ***H01R 12/72*** | (2011.01) |
| *H01R 13/502* | (2006.01) |

(56) References Cited

U.S. PATENT DOCUMENTS

| | | | | |
|---|---|---|---|---|
| 5,637,014 | A | 6/1997 | Sukegawa et al. | |
| 6,210,224 | B1 * | 4/2001 | Wu | 439/607.4 |
| 6,379,184 | B1 * | 4/2002 | Bassler et al. | 439/607.27 |
| 7,811,127 | B2 * | 10/2010 | Tsuzaki et al. | 439/607.01 |
| 7,824,219 | B2 * | 11/2010 | Wang | 439/607.27 |
| 7,833,057 | B1 * | 11/2010 | Yang et al. | 439/607.4 |
| 8,360,808 | B2 * | 1/2013 | Tsuchiya | 439/607.55 |
| 8,475,216 | B2 * | 7/2013 | Tung et al. | 439/660 |
| 2004/0018772 | A1 | 1/2004 | Zhang et al. | |
| 2005/0124219 | A1 | 6/2005 | Chen et al. | |
| 2009/0247013 | A1 * | 10/2009 | Tsuzaki et al. | 439/607.35 |
| 2010/0022132 | A1 * | 1/2010 | Wang | 439/607.27 |
| 2013/0178100 | A1 * | 7/2013 | Nagata et al. | 439/607.35 |

FOREIGN PATENT DOCUMENTS

| | | | |
|---|---|---|---|
| JP | 2-242576 | A | 9/1990 |
| JP | 8-106961 | A | 4/1996 |
| JP | 2009-64716 | A | 3/2009 |
| JP | 2009-66858 | A | 4/2009 |

OTHER PUBLICATIONS

Written Opinion (PCT/ISA/237), dated Nov. 15, 2011, issued by the International Searching Authority in counterpart International Patent Application No. PCT/JP2011/069786.

Search Report, dated Dec. 11, 2013, issued by the European Patent Office, in counterpart Application No. 11821874.2.

Communication from the Japanese Patent Office dated Jul. 15, 2014, in a counterpart Japanese application No. 2010-194471.

Chinese Office Action dated Sep. 22, 2014 issued in corresponding CN Application No. 201180042009.3.

Japanese Office Action dated Sep. 17, 2014 issued in corresponding JP Application No. 2010-194471.

Communication from Japanese Patent Office dated Dec. 9, 2014, in a counterpart Japanese Application No. 2010-194471.

* cited by examiner

BOARD-MOUNTED CONNECTOR

TECHNICAL FIELD

The present invention relates to a board-mounted connector which includes a shield shell for noise resistance or the like, and can be attached onto a circuit board.

BACKGROUND ART

FIGS. 8 to 10 are views illustrating a board-mounted connector disclosed in the following Patent Document 1.

This board-mounted connector 101 includes an external shield shell 111 and a housing assembly 121.

A lower surface 112 which is one surface of the external shield shell 111 is attached onto a circuit board (not shown) such that an electromagnetic shielding space 114 is formed between the external shield shell 111 and the circuit board as shown in FIG. 9. The external shield shell 111 has a front side 113 which is one side perpendicular to a surface of the circuit board and is open for fitting a counterpart connector.

The housing assembly 121 is fit into the external shield shell 111. The counterpart connector is inserted from the open portion on one side of the external shield shell 111 and is fit into the housing assembly 121, thereby being connected to the housing assembly 121.

As shown in FIG. 9, the housing assembly 121 includes a connection terminal member 122 having one end that is a lead terminal 122*a* to be connected to a contact node on the circuit board and the other end that is a connector terminal 122*b* to be fit into a connection terminal of the counterpart connector, thereby being connected thereto, an internal housing 123 that is made of an insulating resin and accommodates the connection terminal member, an internal shield shell 125 that covers the outer circumference of the internal housing 123 and can be conductively connected to a corresponding shield member of the counterpart connector, and an external housing 126 that is made of an insulating resin and accommodates and holds the internal shield shell 125.

An arrow X1 shown in FIG. 8 represents an insertion/extraction direction (fitting direction) of the counterpart connector with respect to the board-mounted connector 101, which is a direction parallel to the surface of the circuit board.

In a case of the board-mounted connector 101, from the beginning, the external shield shell 111 is formed in a shape shown in FIG. 10. In other words, a wall member 116 to be a rear wall to face the open front side 113 is formed in a shape extending in the extension direction of a top wall 117 and open on the rear side as shown in FIG. 10. After the housing assembly 121 is fit from the rear side of the external shield shell 111 into the external shield shell 111, the wall member 116 is bent in a direction shown by an arrow X2 in FIG. 10, thereby holding the housing assembly 121 inside the external shield shell 111.

Also, when the housing assembly 121 is fit into the external shield shell 111, as shown in FIGS. 8 and 10, protrusions 126*a* provided to protrude from the outer surfaces of the external housing 126 are engaged with notches 118 formed at corresponding positions of the external shield shell 111, whereby guiding in the insertion direction is made.

PRIOR ART DOCUMENT

Patent Documents

Patent Document 1: JP-A-2009-64716

<Defects of Board Mounted Connector Disclosed in Patent Document 1>

However, in a process of assembling the board-mounted connector 101 of Patent Document 1, after the housing assembly 121 is fit into the external shield shell 111, it takes a lot of time and trouble to bend the wall member 116 to be the rear wall of the external shield shell 111. Therefore, there is a problem in which workability in the assembling is poor.

Also, when the wall member 116 is bent, since a large load is applied to the external shield shell 111, the inner wall surface of the external shield shell 111 or the like may be deformed, and when the counterpart connector is fit into the board-mounted connector, thereby being connected to the board-mounted connector, this deformation of the external shield shell 111 may cause a trouble such as a bad connection.

<Board-Mounted Connector as Prior Invention of this Application's Invention>

For this reason, in order to overcome the defects (poor workability in assembling, and a reduction in assembly accuracy attributable to deformation of the external shield shell) of the board-mounted connector disclosed in Patent Document 1, the applicant of this application considered a board-mounted connector having an assembly fitting opening provided on the attachment surface side of an external shield shell onto a circuit board so as to allow a housing assembly to be fit from the assembly fitting opening.

FIG. 11 is a perspective view illustrating a board-mounted connector of the prior invention considered in that way, and FIG. 12 is an exploded perspective view illustrating the board-mounted connector shown in FIG. 11.

In a case of the board-mounted connector 1 of the prior invention shown in FIGS. 11 and 12, an external shield shell 11 capable of accommodating an housing assembly 21 and having one surface attachable to a circuit board has an assembly fitting opening 34 which is provided on the attachment surface side onto the circuit board such that the housing assembly 21 can be fit.

As shown in FIG. 12, the housing assembly 21 includes an internal housing 23 that is made of an insulating resin and accommodates a plurality of connection terminal members 22 at predetermined arrangement pitches, an internal shield shell 25 that is formed with a metal plate, covers the outer circumference of the internal housing 23, and can be conductively connected to a corresponding shield member of a counterpart connector, and an external housing 26 that is made of an insulating resin and accommodates and holds the internal shield shell 25.

Each connection terminal member 22 accommodated in the internal housing 23 has one end that is a lead terminal 22*a* to be connected to a contact node on the circuit board and the other end that is a connector terminal 22*b* to be fit into a connection terminal of the counterpart connector, thereby being connected thereto. By insert molding, the connection terminal members 22 are integrally supported by the internal housing 23.

The internal housing 23 is fit into the internal shield shell 25 as shown by an arrow X3, and then the internal shield shell 25 is fit into the external housing 26 as shown by an arrow X4, whereby the housing assembly 21 becomes an integral assembly.

The assembled housing assembly 21 is fit from the assembly fitting opening 34 of the external shield shell 11 into the external shield shell 11 as shown by an arrow X5 in FIG. 12, thereby being assembled with the external shield shell 11.

Also, in the case of the board-mounted connector 1 of the prior invention, at both side walls of the external shield shell 11, notch portions 39 are provided for positioning the housing assembly 21. When the housing assembly 21 is assembled with the external shield shell 11, protrusions 26 formed to protrude from both sides of the external housing 26 are fit into the notch portions 39, whereby the housing assembly 21 is positioned with respect to the external shield shell 11.

<Problems of Prior Invention>

However, the internal housing 23 is a small component separate from the external housing 26 and thus is hard to deal with. Therefore, the above-mentioned housing assembly 21 has a problem in which ease of assembly is bad.

Also, the shielding performance of the external shield shell 11 may be reduced due to the notch portions 39.

SUMMARY OF INVENTION

Problems to be Solved by Invention

For this reason, objects of the present invention are to provide a board-mounted connector which has an assembly fitting opening that is provided on the attachment surface side of an external shield shell onto a circuit board such that a housing assembly can be fit from the assembly fitting opening into the external shield shell, and is capable of improving the ease of assembling the housing assembly, and a board-mounted connector which has an assembly fitting opening that is provided on the attachment surface side of an external shield shell onto a circuit board such that a housing assembly can be fit from the assembly fitting opening into the external shield shell, and is capable of improving the shielding performance of the external shield shell.

Means for Solving Problems

The above-mentioned objects of the present invention can be achieved by the following configurations.

(1) A board-mounted connector comprising an external shield shell having one surface that is attached onto a circuit board so as to form an electromagnetic shielding space between the external shield shell and the circuit board and one side that is perpendicular to a surface of the circuit board and is open for fitting a counterpart connector, and a housing assembly that is fit into the external shield shell and into and to which the counterpart connector is fit and connected from the one side of the external shield shell, wherein the housing assembly includes connection terminal members each of which has one end that is a lead terminal which is connected to a contact node on the circuit board, and the other end that is a connector terminal which is fit into and connected to a connection terminal of the counterpart connector, an internal housing that is made of an insulating resin and accommodates the connection terminal members, an internal shield shell that covers an outer circumference of the internal housing and is conductively connected to a corresponding shield member of the counterpart connector, and an external housing that is made of an insulating resin and accommodates and holds the internal shield shell, and wherein the external shield shell is provided with an assembly fitting opening which is formed on an attachment surface side with respect to the circuit board such that the housing assembly can be fit thereinto, and wherein the internal housing and the external housing which constitute the housing assembly are integrally formed.

(2) The board-mounted connector according to (1), wherein on inner surfaces of both side walls of the external shield shell, positioning spring members are provided to extend along a fitting direction of the housing assembly, and wherein at both side surfaces of the external housing, guide grooves are provided to be engaged with the positioning spring members during fitting into the external shield shell, thereby performing positioning.

According to the above-mentioned configuration (1), the fitting of the housing assembly into the external shield shell is performed from the assembly fitting opening provided on the attachment surface side of the external shield onto the circuit board. Therefore, after the housing assembly is fit, bending a wall member of the external shield shell requiring a lot of time and trouble is unnecessary.

Therefore, workability in assembling is good.

Further, since bending a wall member having caused a large load to be applied to the external shield shell becomes unnecessary, it is possible to achieve a high-accuracy assembled state without causing deformation of the inner wall surface of the external shield shell or the like during assembling.

Also, according to the above-mentioned configuration (1), the internal housing and the external housing which are components of the housing assembly are integrally formed. Therefore, it is possible to reduce the number of components of the housing assembly, thereby simplifying the assembling process. Further, since the internal housing and the external housing are integrally formed, the assembly component has a size easy to deal with, and thus the ease of handling during assembling is improved.

Therefore, it is possible to improve the ease of assembling the housing assembly.

According to the above-mentioned configuration (2), when the housing assembly is fit into the external shield shell, the positioning spring members on the inner surfaces of both side walls of the external shield shell are engaged with the guide grooves of both side surfaces of the external housing, whereby the external housing and the external shield shell are positioned. Therefore, it becomes unnecessary to provide notch portions for positioning the external housing at the external shield shell. As a result, it is possible to improve the shielding performance of the external shield shell.

EMBODIMENTS OF INVENTION

Hereinafter, appropriate embodiments of a board-mounted connector according to the present invention will be described in detail with reference to the drawings.

[First Embodiment]

Figure 1:
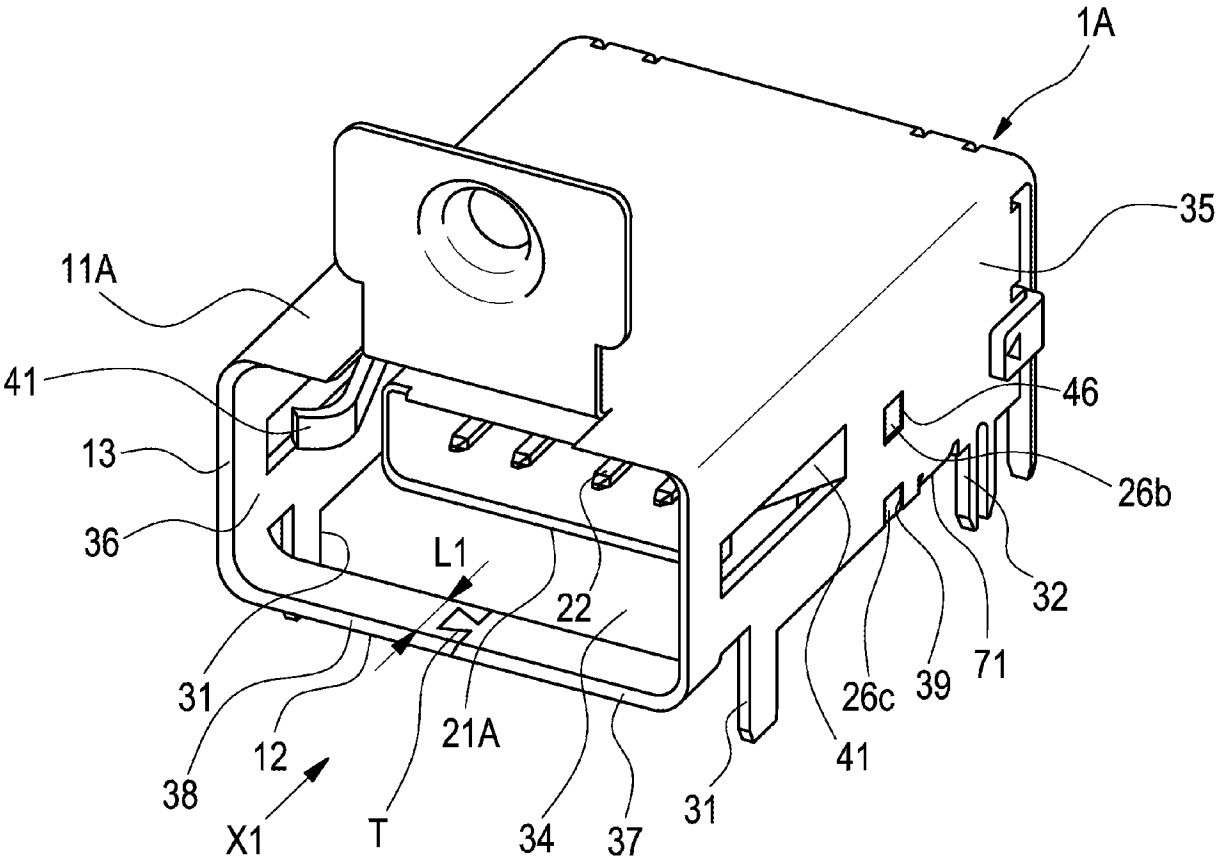
FIG. 1 is a perspective view of a first embodiment of a board-mounted connector according to the present invention.
Figure 2:
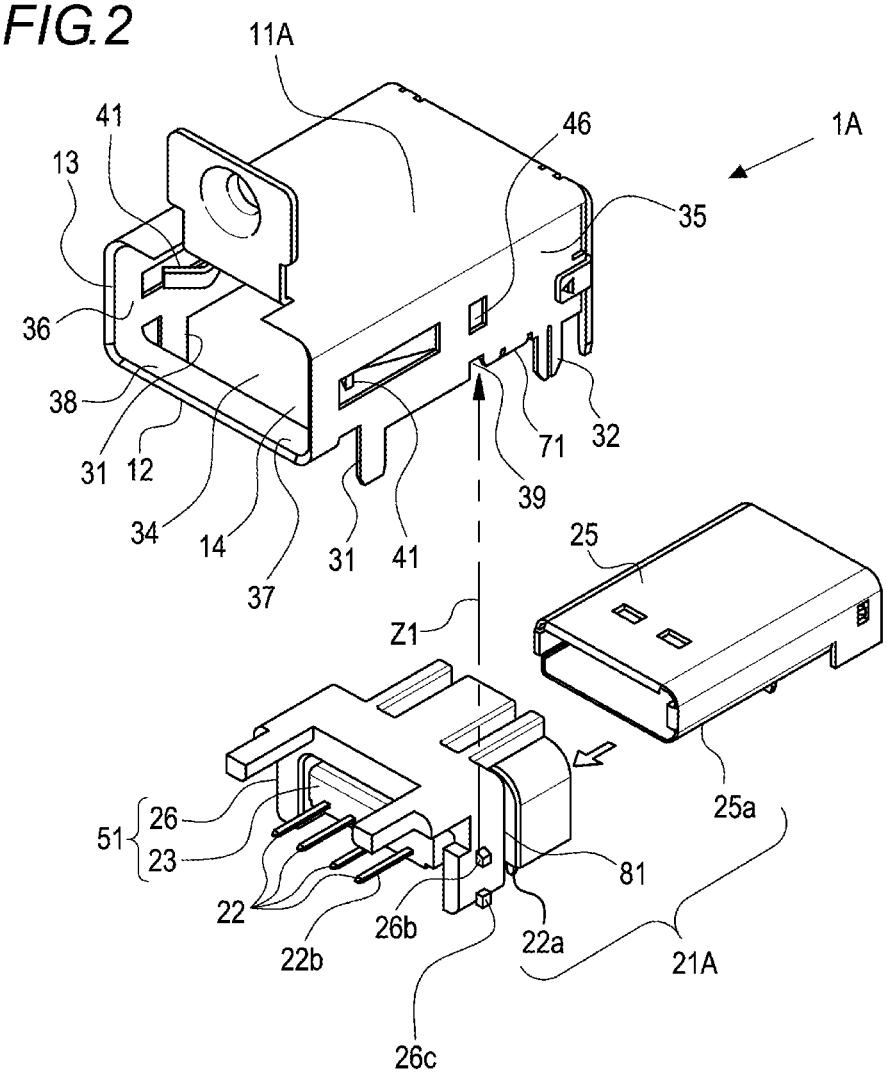
FIG. 2 is an exploded perspective view of the board-mounted connector of the first embodiment.
Figure 3:
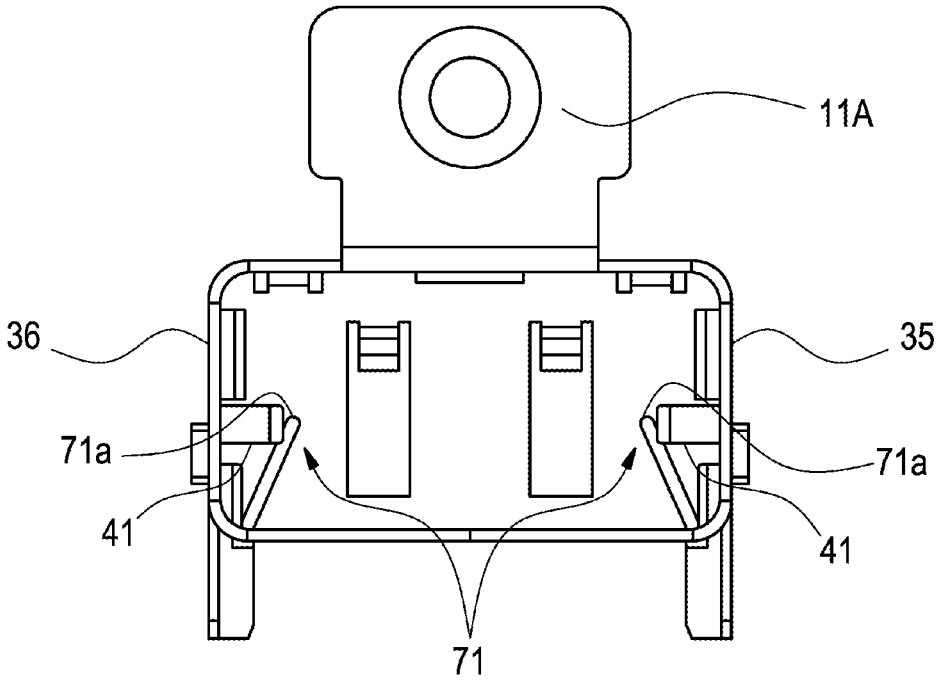
FIG. 3 is a front view of an external shield shell shown in FIG. 2.

FIGS. 1 and 2 show a first embodiment of the board-mounted connector according to the present invention, FIG. 1 is a perspective view of the board-mounted connector of the first embodiment of the present invention, FIG. 2 is an exploded perspective view of the board-mounted connector of the first embodiment, and FIG. 3 is a front view of an external shield shell shown in FIG. 2.

The board-mounted connector 1A of the first embodiment includes an external shield shell 11A and a housing assembly 21A.

Figure 12:
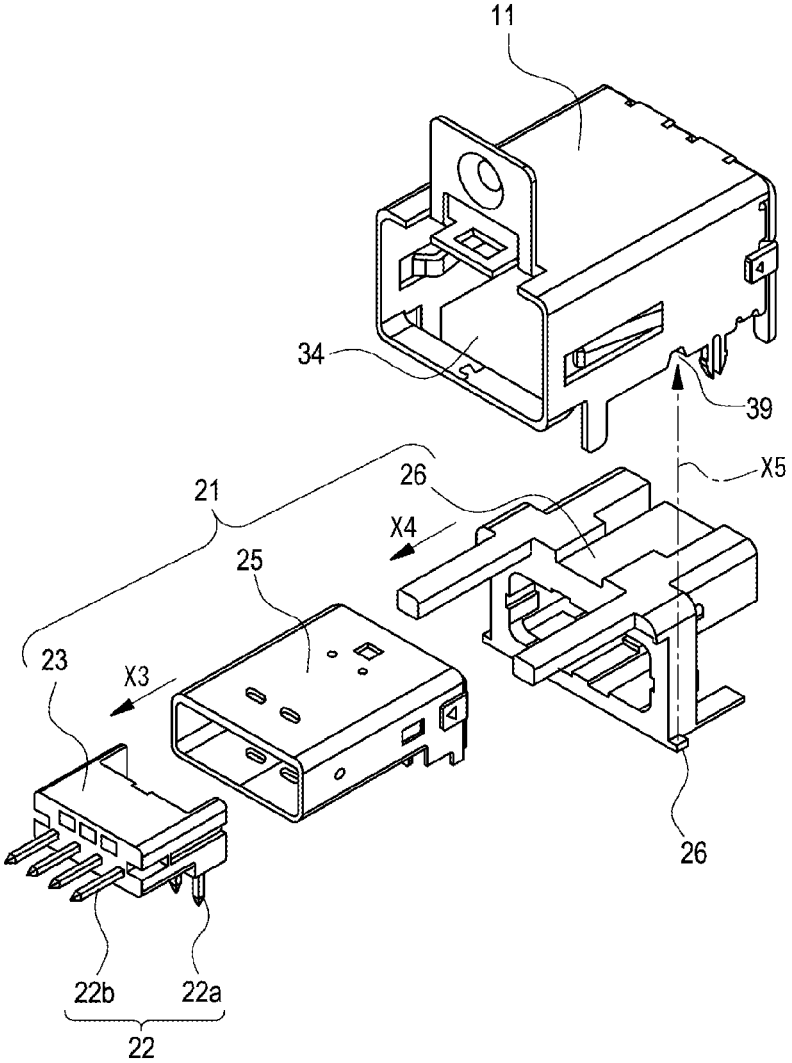
FIG. 12 is an exploded perspective view of the board-mounted connector shown in FIG. 11.

The external shield shell 11A is formed by pressing a metal plate. The basic configuration of the external shield shell 11A may be the same as that of the external shield shell 11 of the prior invention shown in FIG. 12.

A lower surface 12 which is one surface of the external shield shell 11A becomes an attachment surface to be attached onto a circuit board (not shown). The external shield shell 11A attached on the circuit board forms an electromagnetic shielding space 14 between the external shield shell and the circuit board. Also, the external shield shell 11A has a front side 13 which is one side surface perpendicular to the surface of the circuit board and is open for fitting a counterpart connector. An arrow X1 shown in FIG. 1 represents the insertion direction of the counterpart connector.

On the lower surface 12 side of the external shield shell 11A, lag portions 31 and locked pieces 32 for preventing the external shield shell from falling out are provided to protrude toward the circuit board such that the lag portions and the locked pieces can be fit into fitting holes formed at the board.

In a case of the present embodiment, the external shield shell 11A has an assembly fitting opening 34 which is formed at the attachment surface onto the circuit board (that is, the lower surface 12) such that the housing assembly 21A can be fit thereinto.

Also, the assembly fitting opening 34 is set to be far from the front side 13 open for fitting the counterpart connector by a distance L1 as shown in FIG. 1. A portion of the lower surface 12 of the external shield shell 11A adjacent to the front side 13 and corresponding to the distance L1 is composed of connection walls 37 and 38 which connect both side walls 35 and 36 of the external shield shell 11A. The paired connection walls 37 and 38 extend toward the center of the shell along the surface of the circuit board from the lower ends of the both side walls 35 and 36, and are connected in a state where their end portions are face to face with each other. In the case of the present embodiment, the end portions of the connection walls 37 and 38 facing each other are connected by dovetail groove joining T as shown in FIG. 1.

The paired connection walls 37 and 38 lead the bottom surface of the counterpart connector (not shown) into the external shield shell 11A, and functions as a housing which supports the bottom surface of the counterpart connector inserted in the external shield shell 11A and holds the counterpart connector.

On the inner surfaces of the both side walls of the external shield shell 11A as shown in FIG. 1, spring pieces 41 for pressing the side surfaces of the counterpart connector (not shown) inserted in the external shield shell 11A are formed by cutting and raising. Each of the spring pieces 41 is set to have a protruding length from a corresponding side wall such that a pressing force against the corresponding side wall of the counterpart connector becomes desired strength.

Also, as shown in FIG. 3, on the inner surfaces of the both side walls 35 and 36 of the external shield shell 11A, positioning spring members 71*a* and 71*b* are provided to extend along the fitting direction of the housing assembly 21A. The positioning spring members 71*a* and 71*b* position the housing assembly 21A in the left/right direction inside the external shield shell 11A.

As shown in FIG. 2, the external shield shell 11A includes notch portions 39 and locking holes 46 as positioning means during fitting of the housing assembly 21A.

The notch portions 39 are portions which are engaged with engagement confirming protrusions 26*c* provided on an external housing 26 to be described below when the fitting of the housing assembly 21A into the external shield shell 11A is completed. The notch portions 39 are formed at positions visible from the outside of the external shield shell 11A (specifically, the lower edge portions of the both side walls 35 and 36 of the external shield shell 11A) such that the notch portions connect the inside and outside of the external shield shell 11A.

When the fitting of the housing assembly 21A into the external shield shell 11A is completed, the locking holes 46 are engaged with engagement protrusions 26*b* of the external housing 26 to be described below, thereby fixing the housing assembly 21A.

Next, the housing assembly 21 A will be described.

As shown in FIG. 2, the housing assembly 21A is fit from the assembly fitting opening 34 into the external shield shell 11A. The counterpart connector is inserted from an open portion on one side of the external shield shell 11A and then is fit into the housing assembly 21A, thereby being connected thereto.

As shown in FIG. 2, the housing assembly 21A includes connection terminal members 22 each of which has one end that is a lead terminal 22*a* to be connected to a contact node on the circuit board and the other end that is a connector terminal 22*b* to be fit into a connection terminal of the counterpart connector, thereby being connected thereto, an internal housing 23 that is made of an insulating resin and accommodates the plurality of connection terminal members 22 at predetermined arrangement pitches, an internal shield shell 25 that is formed with a metal plate, covers the outer circumference of the internal housing 23, and can be conductively connected to a corresponding shield member of the counterpart connector, and an external housing 26 that is made of an insulating resin and accommodates and holds the internal shield shell 25.

The cross-sectional shape of the internal housing 23 perpendicular to the insertion direction of the connection terminal members 22 is almost a rectangular shape.

The internal shield shell 25 includes a rectangular-tube-like cylindrical portion 25*a* having a cross-sectional shape corresponding to the cross-sectional shape of the internal housing 23.

In the case of the present embodiment, the internal housing 23 and the external housing 26 are made into a single complex housing 51 by integral forming Also, when the complex housing 51 is formed, the plurality of connection terminal members 22 is formed to be accommodated and held in the internal housing 23 by the insert molding.

The internal shield shell 25 is fit into the complex housing 51 such that the internal housing 23 is accommodated in the internal shield shell 25, whereby assembling of the housing assembly 21A of the present embodiment is completed.

In the case of the board-mounted connector 1A of the present embodiment, the assembled housing assembly 21A is inserted into the assembly fitting opening 34 along a direction shown by an arrow Z1 from the lower side of the external shield shell 11A as shown in FIG. 2, and is fit into the external shield shell 11A.

At both side surfaces of an external housing 26B which is interposed between the both side walls 35 and 36 of the external shield shell 11A, guide grooves 81 are provided to be passages for the positioning spring members 71*a* and 71*b*.

Also, on both outer surfaces of the external housing 26 which is interposed between the both side walls 35 and 36 of the external shield shell 11A, the engagement protrusions 26*b* and the engagement confirming protrusions 26*c* are provided as shown in FIG. 2.

When the external housing 26 is inserted up to a predetermined position inside the external shield shell 11A such that the fitting is completed, the engagement protrusions 26*b* are locked by the locking holes 46 of the external shield shell 11A. The locking of the engagement protrusions 26*b* by the locking holes 46 causes the housing assembly 21A to be fixed inside the external shield shell 11A.

When the external housing 26 is inserted up to the predetermined position inside the external shield shell 11A such that the fitting is completed, as shown in FIG. 1 the engagement confirming protrusions 26*c* are fit into the notch portions 39 formed at the both side walls 35 and 36 of the external shield shell 11A. The engagement confirming protrusions 26*c* correspond to the formation positions of the notch portions 39 on the external shield shell 11A, and are provided to protrude from the both outer surfaces of the external housing 26.

In the board-mounted connector 1A of the first embodiment described above, the fitting of the housing assembly 21A into the external shield shell 11A is performed from the assembly fitting opening 34 formed on the lower surface (12) side which is the attachment surface of the external shield shell 11A onto the circuit board. Therefore, after the housing assembly 21A is fit, bending a wall member of the external shield shell requiring a lot of time and trouble is unnecessary. Therefore, workability in assembling is good.

Further, since bending a wall member having caused a large load to be applied to the external shield shell 11A becomes unnecessary, it is possible to achieve a high-accuracy assembled state without causing deformation of the inner wall surface of the external shield shell 11A or the like during assembling.

Also, in the case of the board-mounted connector 1A of the present embodiment, the internal housing 23 and the external housing 26 which are components of the housing assembly 21A are integrally formed. Therefore, it is possible to reduce the number of components of the housing assembly 21A, thereby simplifying the assembling process. Further, since the internal housing 23 and the external housing 26 are integrally formed, the assembly component has a size easy to deal with, so the ease of handling during assembling is improved.

Therefore, it is possible to improve the ease of assembling the housing assembly.

[Second Embodiment]

Figure 4:
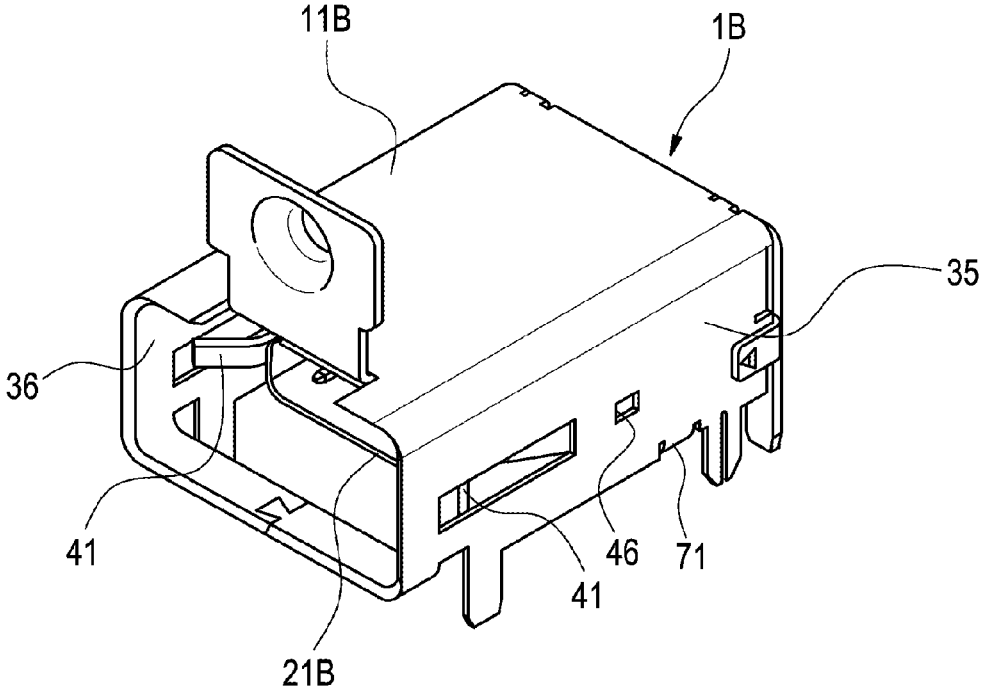
FIG. 4 is a perspective view of a second embodiment of the board-mounted connector according to the present invention.
Figure 5:
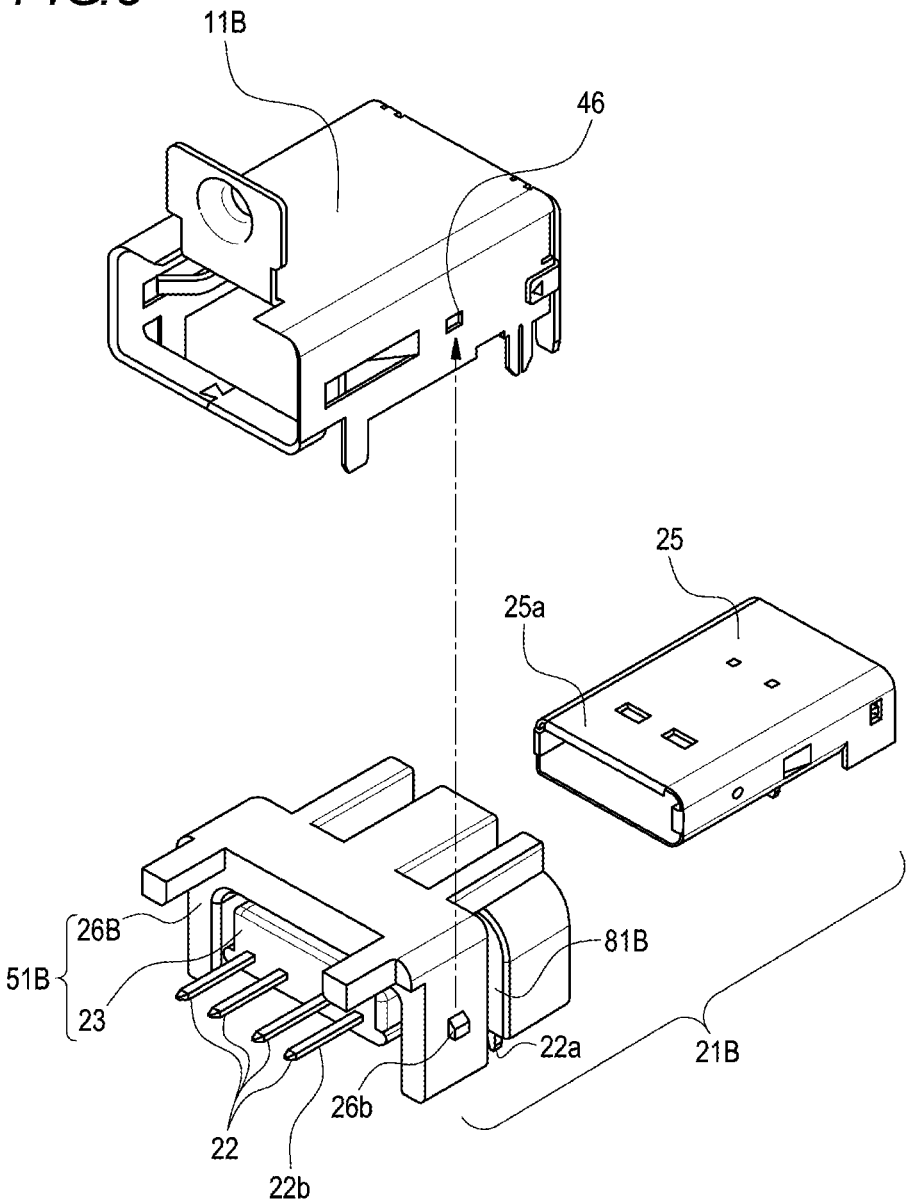
FIG. 5 is an exploded perspective view of the board-mounted connector of the second embodiment.
Figure 6:
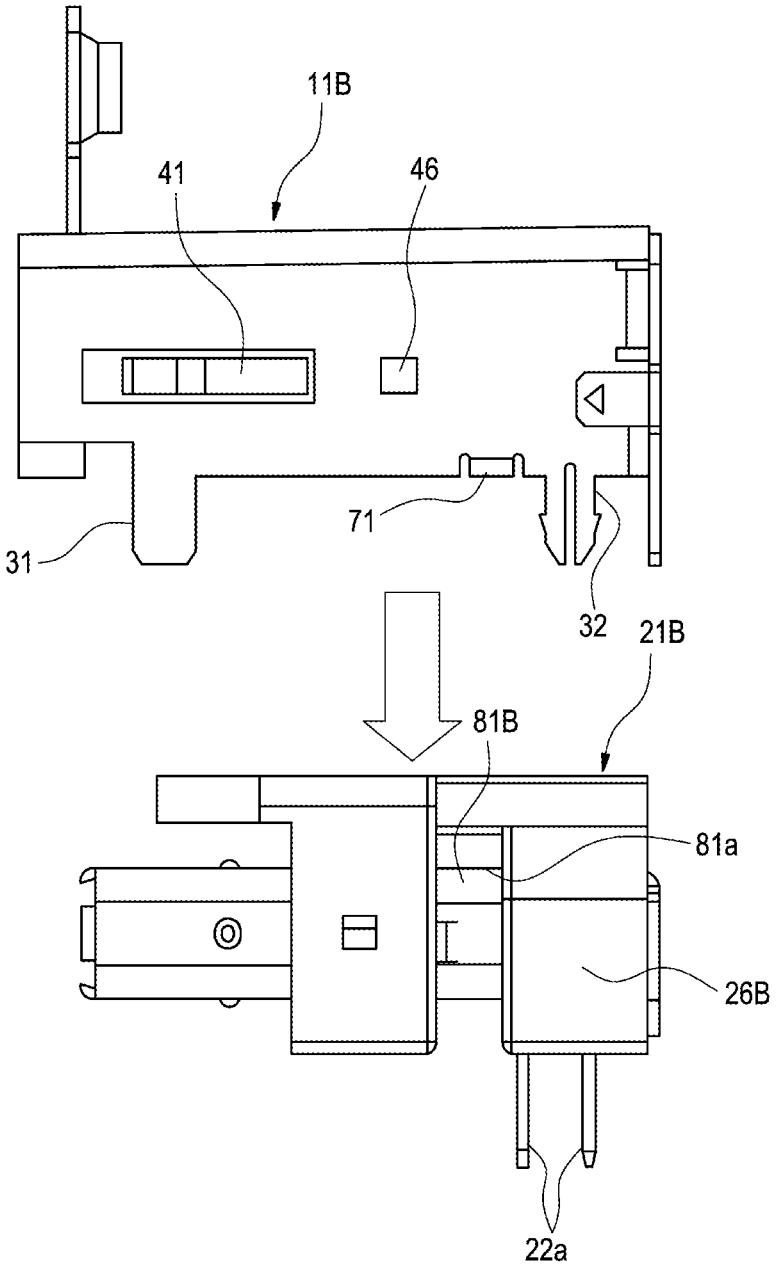
FIG. 6 is an explanatory view of a process of assembling the board-mounted connector of the second embodiment.
Figure 7:
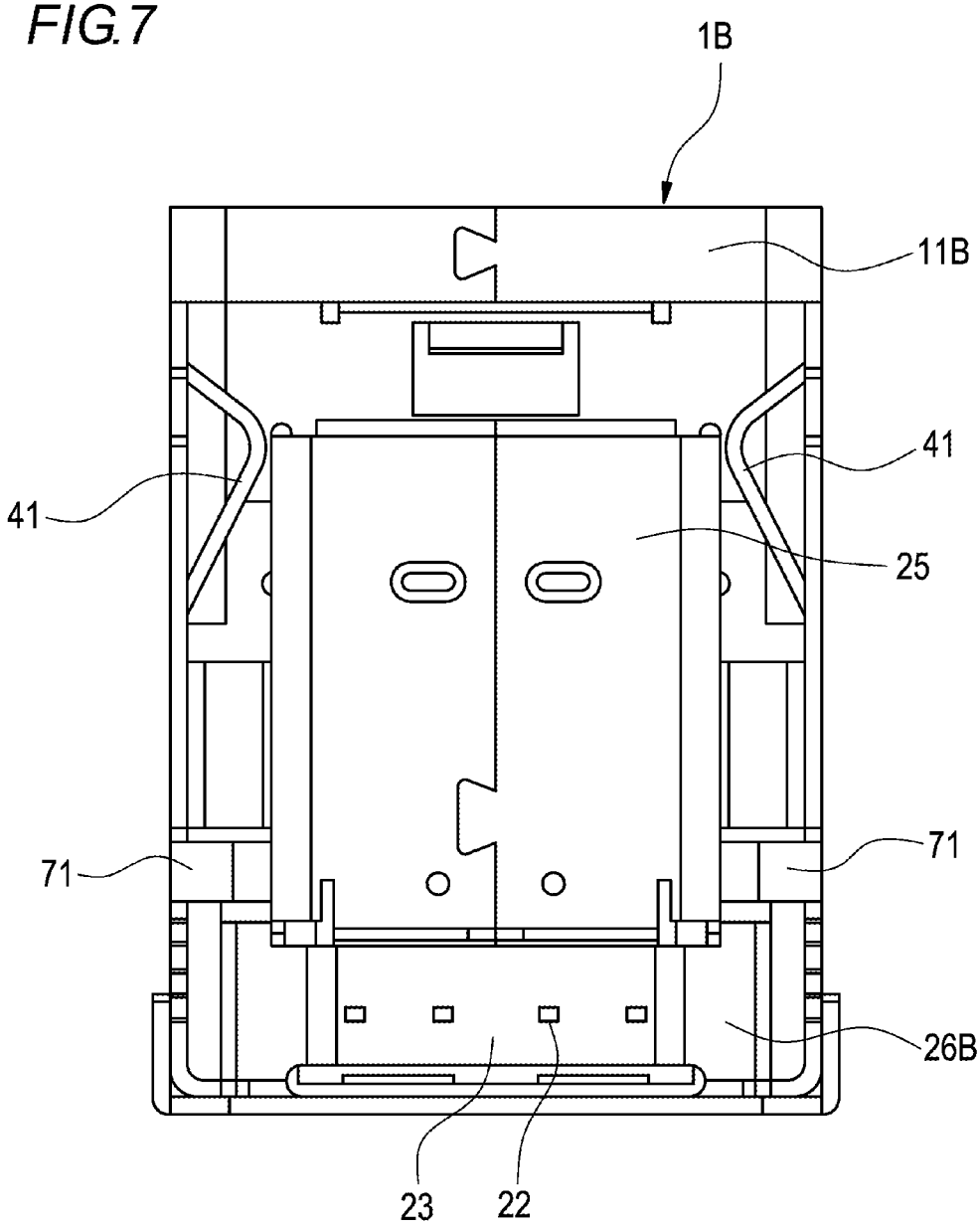
FIG. 7 is a bottom view of the board-mounted connector of FIG. 3.
Figure 8:
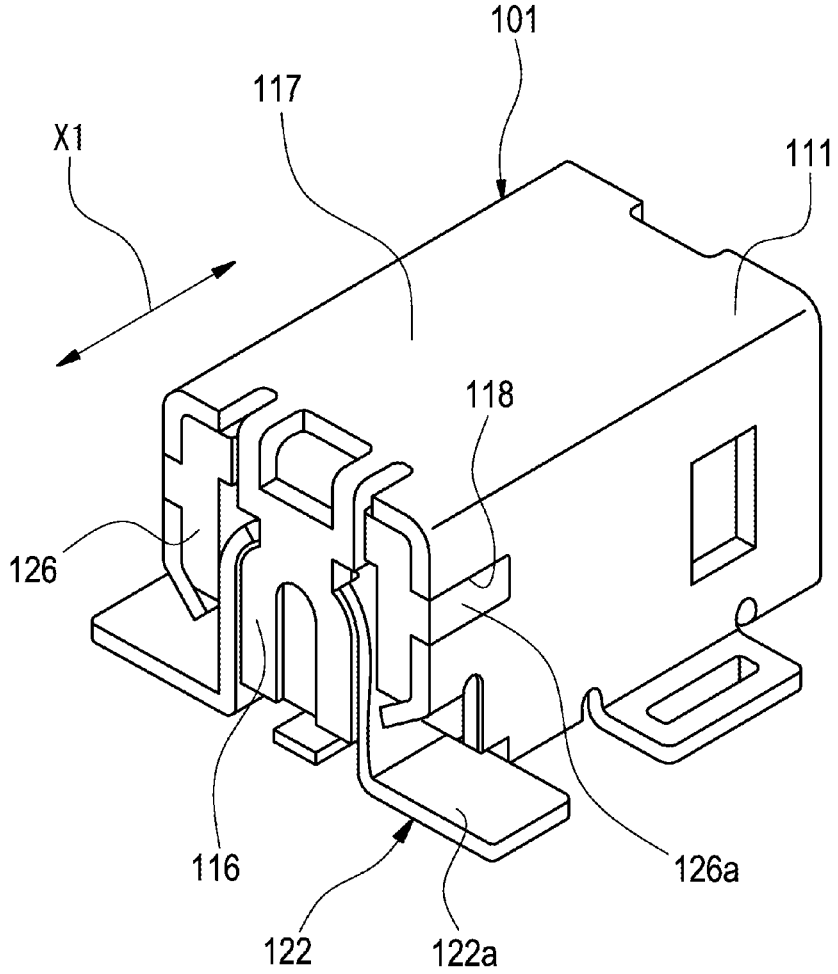
FIG. 8 is a perspective view of a board-mounted connector according to the related art.
Figure 9:
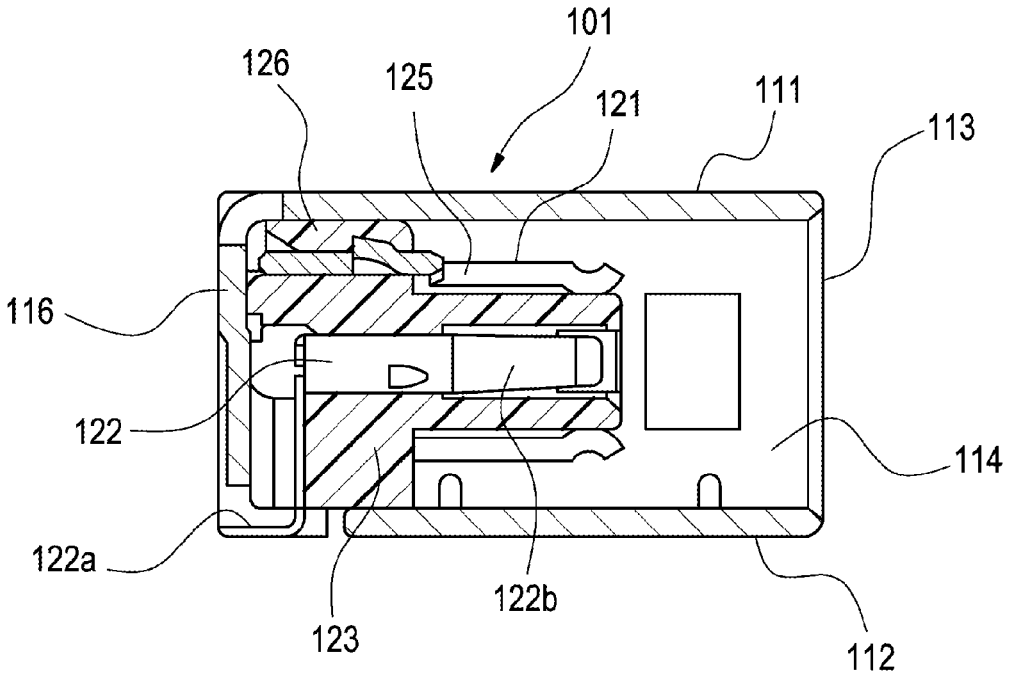
FIG. 9 is a longitudinal sectional view of the board-mounted connector of FIG. 8.
Figure 10:
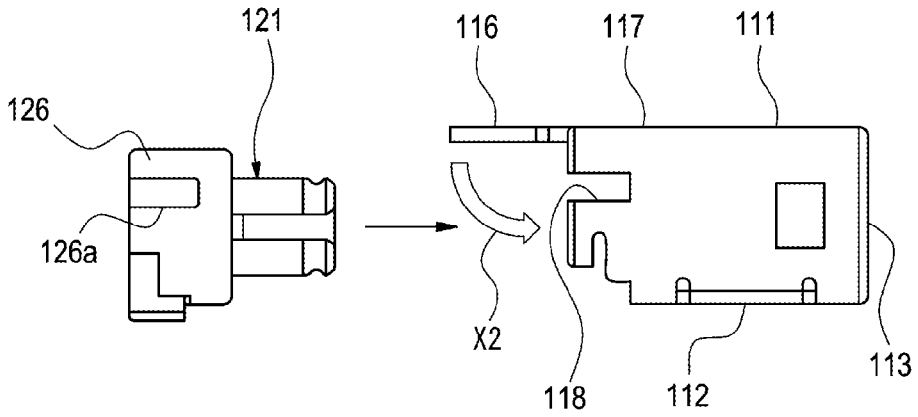
FIG. 10 is an explanatory view of a process of assembling the board-mounted connector shown in FIG. 9.
Figure 11:
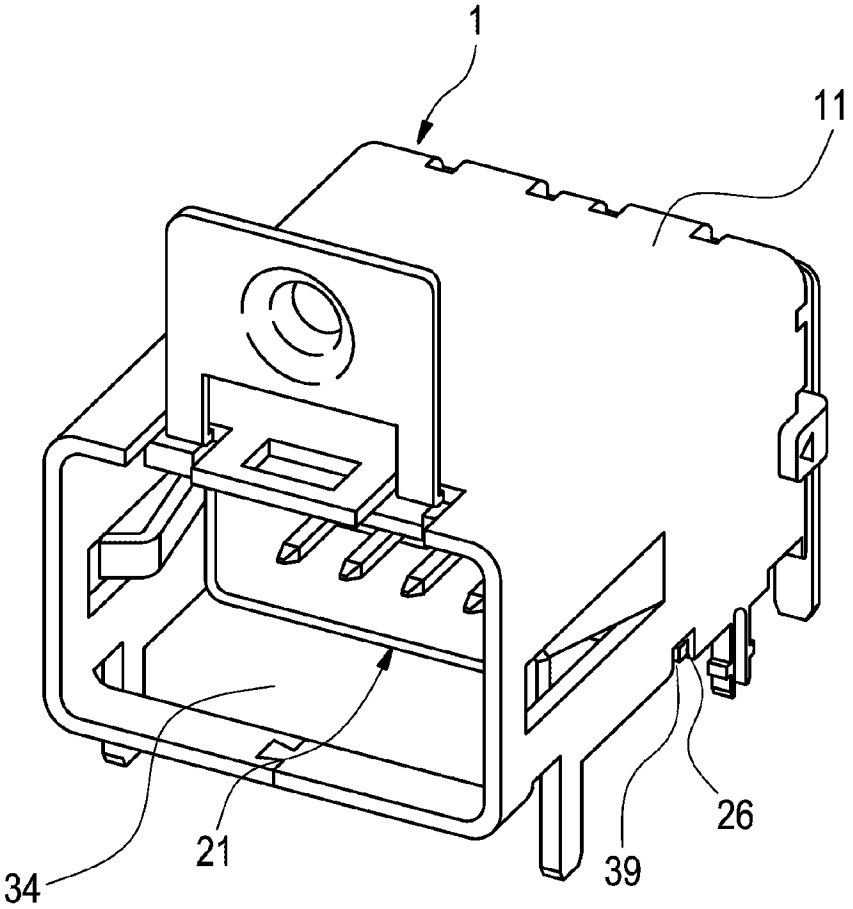
FIG. 11 is a perspective view of a board-mounted connector of a prior invention.

FIGS. 4 to 7 are views illustrating a second embodiment of the board-mounted connector according to the present invention, FIG. 4 is a perspective view of the board-mounted connector of the second embodiment of the present invention, FIG. 5 is an exploded perspective view of the board-mounted connector of the second embodiment, FIG. 6 is an explanatory view of a process of assembling the board-mounted connector of the second embodiment, and FIG. 7 is a bottom view of the board-mounted connector of FIG. 4.

The board-mounted connector 1B of the second embodiment includes an external shield shell 11B and a housing assembly 21B.

The external shield shell 11B of the second embodiment has been obtained by improving a portion of the external shield shell 11A of the first embodiment.

The improved points are a point in which the guide grooves 81 of an external housing 26A of the first embodiment has been used to position the positioning spring members 71*a* and 71*b* in the front/rear direction, and a point in which the notch portions 39 provided at the external shield shell 11A of the first embodiment has been abolished.

In the case of the external shield shell 11B of the second embodiment, components other than the above-mentioned improved points may be common to the first embodiment, and the components common to the first embodiment are denoted by the same reference symbols as those in the first embodiment and will not be described.

The housing assembly 21B of the second embodiment is obtained by fitting the internal shield shell 25 into a complex housing 51B as shown in FIG. 5.

The complex housing 51B is obtained by integrally forming the internal housing 23 and the external housing 26B, and the basic configuration as the housing assembly is common to the first embodiment.

However, as compared to the external housing 26 of the first embodiment, the external housing 26B of the second embodiment has the following improved point.

The improved point of the external housing 26B of the second embodiment relative to the external housing 26 of the first embodiment is that guide grooves 81B to position positioning spring members 71A and 71B in the front/rear direction and the vertical direction are provided at both side surfaces of the external housing 26B as shown in FIGS. 5 to 7. The guide grooves 81B have step portions 81*a* with which the front ends 71*a* of the positioning spring members 71 are engaged when being fit into the external shield shell 11B as shown in FIG. 6, and performs positioning by the engagement with the positioning spring members 71. The guide grooves 81B are small as long as a play with the positioning spring members 71 in the front/rear direction is possible.

Further, in the external housing 26B of the second embodiment, as an improved point according to the abolishment of the notch portions 39 in the external shield shell 11B, the engagement confirming protrusions 26*c* included in the external housing 26 of the first embodiment are abolished.

In a case of the external housing 26B of the second embodiment, components other than the above-mentioned improved points may be common to the first embodiment, and the components common to the first embodiment are denoted by the same reference symbols as those in the first embodiment and will not be described.

In the board-mounted connector 1B of the second embodiment described above, in addition to the functions and effects of the first embodiment, the following functions and effects can be obtained.

In other words, in the board-mounted connector 1B of the second embodiment, as shown in FIGS. 6 and 7, when the housing assembly 21B is fit into the external shield shell 11B, the positioning spring members 71 on the inner surfaces of the both side walls 35 and 36 of the external shield shell 11B are engaged with the guide grooves 81B at the both side surfaces of the external housing 26B, whereby the external housing 26B and the external shield shell 11B are positioned in the front/rear direction and the vertical direction. Further, since the notch portions (the notch portions 39 of FIG. 2) included in the external shield shell 11A of the first embodiment are abolished in the second embodiment, as compared to the first embodiment, it is possible to improve the shielding performance.

Also, the board-mounted connector of the present invention is not limited to the above-mentioned individual embodiments, but can be appropriately modified and improved. Further, the materials, shapes, dimensions, and the like of the board-mounted connectors of the present invention are arbitrary as long as the objects of the present invention can be achieved, and are not limited.

Although the present invention has been described in detail with reference to the specific embodiments, it is apparent to those skilled in the art that it is possible to add various changes or modifications without departing from the sprit and scope of the present invention.

This application is based on Japanese Patent Application (Application No. 2010-194471) filed on Aug. 31, 2010 whose contents are incorporated herein by reference.

INDUSTRIAL APPLICABILITY

According to the board-mounted connectors based on the present invention, fitting of the housing assembly into the external shield shell is performed from the assembly fitting opening provided on the attachment surface side of the external shield shell onto the circuit board. Therefore, after the housing assembly is fit, bending a wall member of the external shield shell requiring a lot of time and trouble is unnecessary.

Therefore, workability in assembling is good.

Further, since bending a wall member having caused a large load to be applied to the external shield shell becomes unnecessary, it is possible to achieve a high-accuracy assembled state without causing deformation of the inner wall surface of the external shield shell or the like during assembling.

Also, according to the board-mounted connectors based on the present invention, the internal housing and the external housing which are components of the housing assembly are integrally formed. Therefore, it is possible to reduce the number of components of the housing assembly, thereby simplifying the assembling process. Further, since the internal housing and the external housing are integrally formed, the assembly component has a size easy to deal with, so the ease of handling during assembling is improved.

Therefore, it is possible to improve the ease of assembling the housing assembly.

DESCRIPTION OF REFERENCE NUMERALS

1A, 1B Board-Mounted Connector
11A, 11B External Shield Shell
13 Front Surface
21A, 21B Housing Assembly
22 Connection Terminal Member
23 Internal Housing
25 Internal Shield Shell
26, 26B External Housing
26*b* Engagement Protrusion
34 Assembly Fitting Opening
35, 36 Side Wall
39 Notch Portion
41 Spring Piece
51, 51B Complex Housing
71 Positioning Spring Member
81 Guide Groove

The invention claimed is:

1. A board-mounted connector comprising an external shield shell having one surface that is attached onto a circuit board so as to form an electromagnetic shielding space between the external shield shell and the circuit board and one side that is perpendicular to a surface of the circuit board and is open for fitting a counterpart connector, and a housing assembly that is fit into the external shield shell and into and to which the counterpart connector is fit and connected from the one side of the external shield shell, wherein the housing assembly includes connection terminal members each of which has one end that is a lead terminal which is connected to a contact node on the circuit board, and the other end that is a connector terminal which is fit into and connected to a connection terminal of the counterpart connector, an internal housing that is made of an insulating resin and accommodates the connection terminal members, an internal shield shell that covers an outer circumference of the internal housing and is conductively connected to a corresponding shield member of the counterpart connector, and an external housing that is made of an insulating resin and accommodates and holds the internal shield shell;

the external shield shell is provided with an assembly fitting opening which is formed on an attachment surface side with respect to the circuit board such that the housing assembly can be fit thereinto;

the internal housing and the external housing which constitute the housing assembly are integrally formed;

on inner surfaces of both side walls of the external shield shell, positioning spring members are provided to extend along a fitting direction of the housing assembly;

at both side surfaces of the external housing, guide grooves are provided to be engaged with the positioning spring members during fitting into the external shield shell, thereby performing positioning; and the guide grooves extend in a direction perpendicular to a face of the circuit board on which the external shield shell is attached.

* * * * *